US006454137B1

(12) United States Patent
Sturk

(10) Patent No.: US 6,454,137 B1
(45) Date of Patent: Sep. 24, 2002

(54) FLOW VENTED AND PRESSURE VENTED CLOSURES

(76) Inventor: Ron Sturk, 38 Lorne Avenue, Brampton, Ontario (CA), L6X 1L1

( * ) Notice: Subject to any disclaimer, the term of this patent is extended or adjusted under 35 U.S.C. 154(b) by 0 days.

(21) Appl. No.: 09/807,073

(22) PCT Filed: Dec. 8, 1999

(86) PCT No.: PCT/CA99/01172

§ 371 (c)(1),
(2), (4) Date: Apr. 9, 2001

(87) PCT Pub. No.: WO00/34132

PCT Pub. Date: Jun. 15, 2000

Related U.S. Application Data

(60) Provisional application No. 60/111,783, filed on Dec. 10, 1998.

(51) Int. Cl.[7] ..... B67D 5/58

(52) U.S. Cl. ..... 222/189.09; 222/481.5; 222/529; 222/530

(58) Field of Search ..... 222/189.09, 481.5, 222/478, 529, 530

(56) References Cited

U.S. PATENT DOCUMENTS

| | | | | | |
|---|---|---|---|---|---|
| 3,040,938 | A | * | 6/1962 | Smith | 222/478 |
| 4,295,583 | A | * | 10/1981 | Schurr | 222/478 |
| 4,618,078 | A | * | 10/1986 | Hamman et al. | 222/478 |
| 5,097,992 | A | * | 3/1992 | Shiemann | 222/481.5 |
| 5,183,184 | A | * | 2/1993 | Ranalletta et al. | 222/189.09 |
| 5,788,100 | A | * | 8/1998 | Sturk | 215/258 |
| 5,941,425 | A | * | 8/1999 | Stolz | 222/153.14 |
| 5,967,376 | A | * | 10/1999 | McLelland et al. | 222/529 |
| 6,073,812 | A | * | 6/2000 | Wade et al. | 222/189.09 |

* cited by examiner

*Primary Examiner*—Joseph A. Kaufman
(74) *Attorney, Agent, or Firm*—Eugene J. A. Gierczak

(57) ABSTRACT

A closure for a container having an opening, comprising a baffle having at one end a surface for blocking communication with the opening, an orifice at a top end of the baffle for communicating with the opening.

12 Claims, 10 Drawing Sheets

FLOW VENTED AND PRESSURE VENTED CLOSURES

This application claims the benefit of provisional application No. 60/111,783 filed on Dec. 10, 1998.

FIELD OF INVENTION

This invention relates to nestable and extendable pouring spouts for containers and in particular to spouts having flow venting means for smoothing liquid flow from the container, and pressure venting means to equalize internal container pressure with atmospheric pressure.

BACKGROUND ART

One aspect of this invention is the provision of flow venting means to improve liquid dispensing.

During dispensing the loss of liquid volume and pressure inside the container is replaced with air entering the container. Liquid pulsations may result when the liquid flowing out of the container must share the same path with air entering the container. Extendable pour spouts connected to containers are particularly susceptible to liquid pulsations as the liquid flow generally converges and outlets through a narrow nozzle or neck. The incorporation of self-venting or flow venting devices assist the entry of air into containers and to smooth the outflow of the liquid contents is a common practice. Smooth pouring may also be obtained with unvented containers by carefully controlling the angle of pour so that the spout nozzle never flows full, thereby maintaining an air passage through the spout into the container. Establishing and maintaining this proper pouring angle can be difficult or unmanageable because of the high initial liquid level and because of the weight of full containers.

Installing a separate air vent in the container which is opened to allow air to enter above the level of the liquid is another common practice, particularly for viscous liquids. The container may or may not have a separate cover. However, the provision of separate vents are generally more costly to manufacture, create the possibility of potential leaks and require more time to open and reseal the second closure. In the absence of venting means provided by the container manufacturer, a common practice is for the user to pierce a vent hole in the container cover opposite the location of the pour spout. The pierced vent hole, if not resealed tightly, may expose the container contents to contaminants.

Another goal of this invention is an improved method of closure insertion and attachment to the container. In the manufacture of plastic containers, production efficiency may be improved by installing the closure to the container as soon as it is molded. These hot molded plastic containers lack the rigidity of cold containers, so closure insallation forces must be low. Hot plastic containers may be molded oversize to compensate for shrinkage as they cool. Closure which have a means of self alignment with the container opening can improve the efficiency of installation operators and machinery. Larger lead in angles on the closure body skirt help capture the container rim. Internal locking means that resist external tampering to remove the closure is also desirable.

Prior art spouts have been fitted with self-venting (flow venting) devices for maintaining an air passage through the spout regardless of the angle of pouring. Prior art pour spouts have also been equipped with pressure venting means. Pour spout closures may be equipped with both flow venting means and pressure venting means depending upon the application.

For example central tube type flow ventilation devices are illustrated in U.S. Pat. Nos. 3,040,938 and 4,295,583 which illustrates a vented pour spout wherein a venting unit is rigidly secured to the inside surface of a flexible pour spout. This venting unit permits the entry of air into the container so as to enable a smooth flow of liquid from the container by way of the pour spout.

These prior venting devices are essentially tubes mounted concentrically within the neck of the spout so as to form an annular air space between the tube and the neck. The base of the tube is fitted with a flange having a plurality of small peripheral channels, which flange is drawn up against the base of the spout when the spout is in the extended orientation. In this orientation, air may enter the container through the annular space and peripheral channels while the fluid exits through the central tube.

A disadvantage associated with this structure concerns the self-venting attachment which is bonded to the neck portion of the spout and adds to the overall axial length of the closure when in the nested position, thus increasing handling packaging and shipping costs of such spouts. It would be desirable to provide a nestable an extendable pouring spout with self contained venting means which maintains the compact configuration of such spouts which was a goal of U.S. Pat. Nos. 4,555,938 and 4,618,078.

Centrally restricted aperture flow vented devices are illustrated in U.S. Pat. Nos. 4,555,048 and 4,618,078.

These vented nestable pouring spout generally illustrate devices having a plurality of circumferentially spaced ears attached to the spout and extended therefrom. The ears extend inwardly substantially perpendicular to the longitudinal axis of the neck portion of the spout when the spout is in the extended orientation; the ears define a central restricted flow aperture for the outflow of liquid and the adjacent ears defines a peripheral vent opening therebetween for the inflow of air.

One disadvantage associated with this self-vented closure is the location of the "ears" in close proximity to the annular recess where the closure is mounted onto covers during installation. The ears and rib extensions may inadvertently be caught on the outside of the annular rim of the cover opening during installation, resulting in a spout that may leak.

A cone shaped internal attachment flow device is shown in U.S. Pat. No. 4,295,583. The nestable self-venting attachment is a truncated cone in shape. The wide end of the cone is light pressed fit onto a retracted pour spout closure with a metal attachment ring. A thin flange on the wide end of the cone is captured behind the bead of the cover opening during installation, permanently securing the cone shaped vent. The base of the cone has a flat portion and a re-entrant cylinder which defines the central nozzle to control and channel the liquid flow. There are a number of small rectangular vent openings evenly spaced around the circumference of the cone. These vents are located close to the wide end of the cone, which would place the small vent openings near the inner surface of the cover when the closure is installed.

The vent attachment does not move when the pour spout is extended, and the vent holes and the central nozzle maintain their position relative to the inside of the cover.

A disadvantage of this design is the reliance on the small rectangular vent openings to empty the container once the liquid level has fallen below the level of the central nozzle.

The cone sidewall becomes a sump which blocks liquid and may result in longer emptying time or lost product.

Prior art pour spout closures equipped for pressure venting are commonly fitted with buna rubber valves or the like. The buna valve is inserted through an opening in the closure to create a restricted vent path. The valve head has a rubber annular lip which in the normal position creates a liquid tight seal. Pressure build up forces the rubber annular lip to lift and open the vent path. The buna valve will reclose the vent path once the pressure has dropped. One problem with buna pressure valves is that it is uni-directional and can only relieve pressure in one direction. Closures equipped for pressure or vacuum venting are manufactured and sold separately for specific applications. It would be desirable to have a bi-directional vent.

Prior art pour spout closures equipped for relieving pressure may allernately be fitted with an orifice covered with a gas permeable microporous membrane made of teflon or the like.

Buna and microporous vents may become fouled and inoperable due to liquid in the container wetting the vent and subsequen build up of crystals or other deposits which foul the vent. For example sodium hypochloride in bleach tends to dry as crystals which can foul vents. Sugar crystals from food products may have a similar effect. A baffle which blocks the splashing of the liquid onto the pressure vent would correct this problem.

Closures that are partially submerged in the liquid may have the liquid level in the nozzle area rise due to internal pressure. The pressure vent then becomes flooded with liquid under pressure. Liquid may eventually escape to the outside of the continer. A baffle which would block liquid from direct contact with the pressure vent would be an improvement over the prior art.

Prior an pour spout closures are attached to containers with various methods including press in interference fit, ultrasonic welding, insert molding, metal crimp rings and plastic lock rings. A closure with two position lock ring is illustrated in U.S. Pat. No. 5,788,100. The plastic closure has a cap with outer locking ring formed integrally and co-axially. The closure spout skirt first moves over the container bead and back into a partially relaxed position before the locking ring is moved into the locking position.

The closure disclosed in U.S. Pat. No. 5,788,100 works exceedingly well, however a further improvement on this prior art would be to widen the outer flange on the skirt so that the closure could more readily slide over the rim and bead of the container opening. This a particular advantage when installing closures on hot molded containers. The container opening is typically molded oversize to allow for plastic shrinkage as the plastic container cools.

A further improvement in this prior art would be to incorporate internal locking means in the flow venting baffle to discourage removal of the closure by tampering or by impact. The addition of baffle guide ribs to help guide the closure into coaxial alignment with the container opening would further improve the assembly operation.

It is an object of this invention to provide flow venting means to improve liquid dispensing.

It is another object of this invention to provide an improved method of mounting pressure vents in closures, and a method for blocking the liquid in the container from directly contacting the pressure vents.

It is another object of this invention to provide improved closure installations and locking features.

It is another aspect of this invention to provide a closure for a container, the closure comprising an inner baffle, body spout and cap, the baffle have surfaces from restricting liquid flow through the spout opening.

Another aspect of this invention relates to a closure for a container comprising a spout for dispensing liquids from said container, said spout engageable with said container at one end thereof; an internal baffle having surfaces for restricting liquid flow through the spout opening, and said internal be having a plurality of orifice for regulating liquid passage out of the container and air passage into the container.

List of Drawing Numbers

Figure 1:
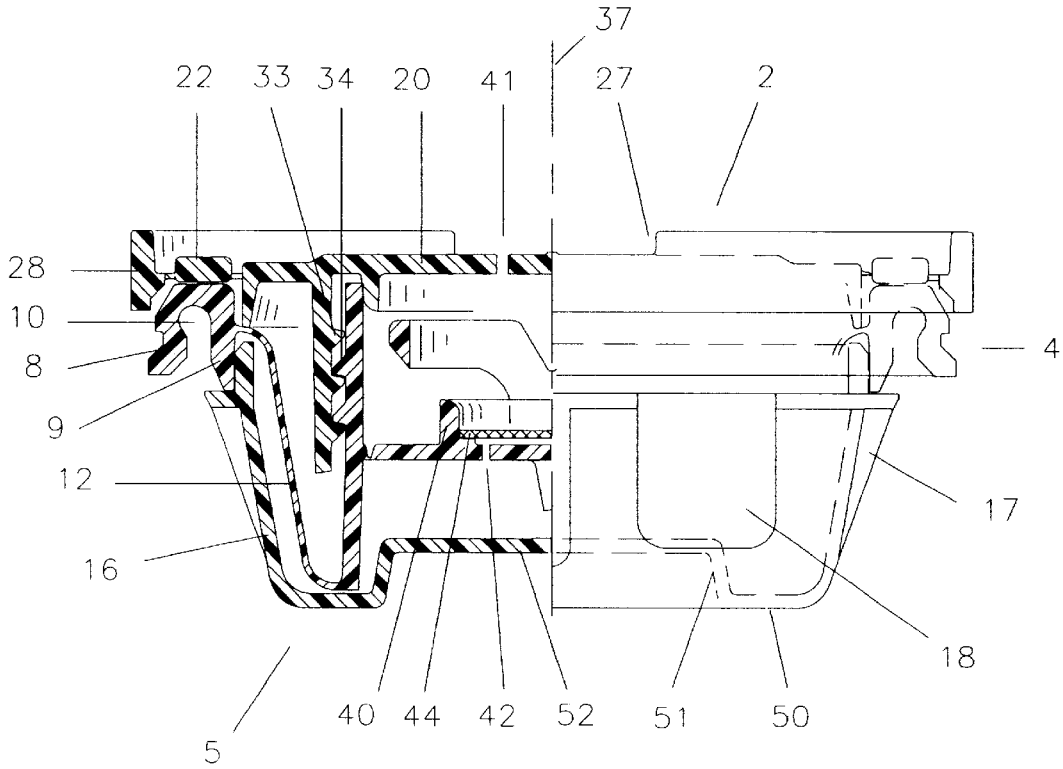
FIG. 1 is a cross-sectional side view of a flow vented and pressure vented pour spout closure.

| Number | Description |
|---|---|
| 1. | container cover |
| 2. | pour spout closure |
| 3. | cover opening rim |
| 4. | closure body |
| 5. | flow venting baffle |
| 6. | cover rim bead |
| 7. | body nozzle |
| 8. | body skirt |
| 9. | body flange |
| 10. | skirt annular recess |
| 12. | body funnel |
| 13. | not used |
| 14. | baffle mounting ring |
| 15. | locking tab |
| 16. | baffle outer wall |
| 17. | guide rib |
| 18. | flow vent orifice |
| 19. | end surface |
| 20. | cap |
| 21. | cap rim |
| 22. | cap bail |
| 23. | bail lift tab |
| 24. | inner frangible web |
| 25. | outer frangible web |
| 26. | not used |
| 27. | lock ring notch |

-continued

List of Drawing Numbers

| Number | Description |
|---|---|
| 28. | lock ring |
| 29. | hinge |
| 30. | skirt bevel |
| 31. | skirt flat edge |
| 33. | cap threads |
| 34. | body threads |
| 35. | removable diaphragm |
| 35a. | pull ring |
| 37. | central axis |
| 38. | liquid |
| 39. | air |
| 40. | cylindrical projection |
| 41. | cap pressure orifice |
| 42. | body pressure orifice |
| 43. | pressure vent orifice |
| 44. | microporous vent |
| 45. | microporous membrane |
| 46. | mounting disc |
| 47. | disc orifice |
| 48. | taper |
| 49. | step |
| 50. | end wall |
| 51. | end wall shoulder |
| 52. | end wall sump |
| 53. | body flange inner wall |
| 54. | baffle mounting ring outer wall |
| 55. | baffle pressure vent channel |
| 56. | body nozzle sump |
| 57. | top end of baffle |

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

FIG. 1 is a cross-sectional side view of a flow vented and pressure vented pour spout closure 2. The closure is generally indicated by the numeral 2. The flow vented closure 2 generally comprises a spout or closure body 4 made of flexible plastic or the like, a cap 20 and a flow venting baffle 5. Both cap and baffle are made from suitable material such as semi-rigid plastic or the like.

Figure 7:
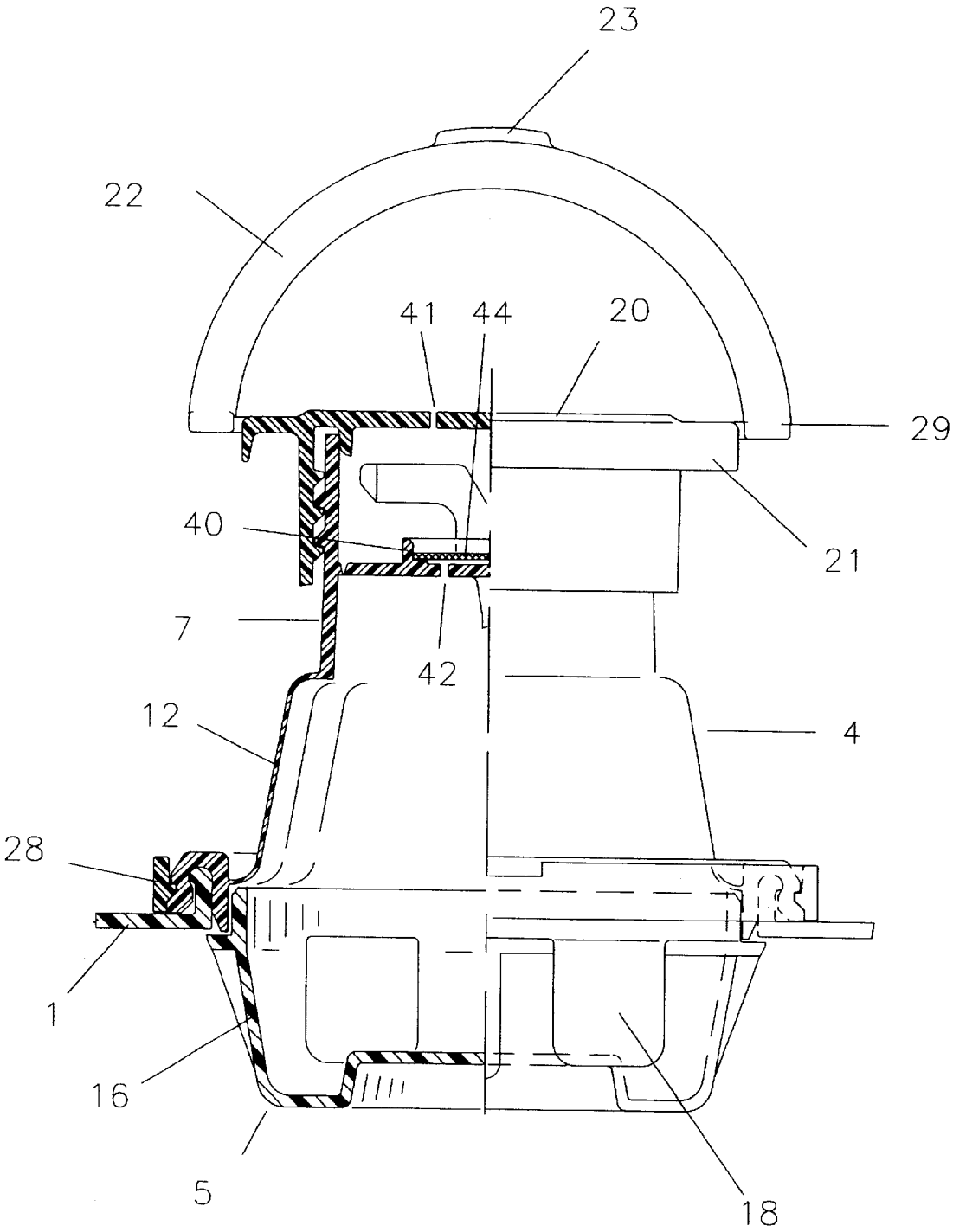
FIG. 7 is cross-sectional side view of the pour spout closure extended.
Figure 8:
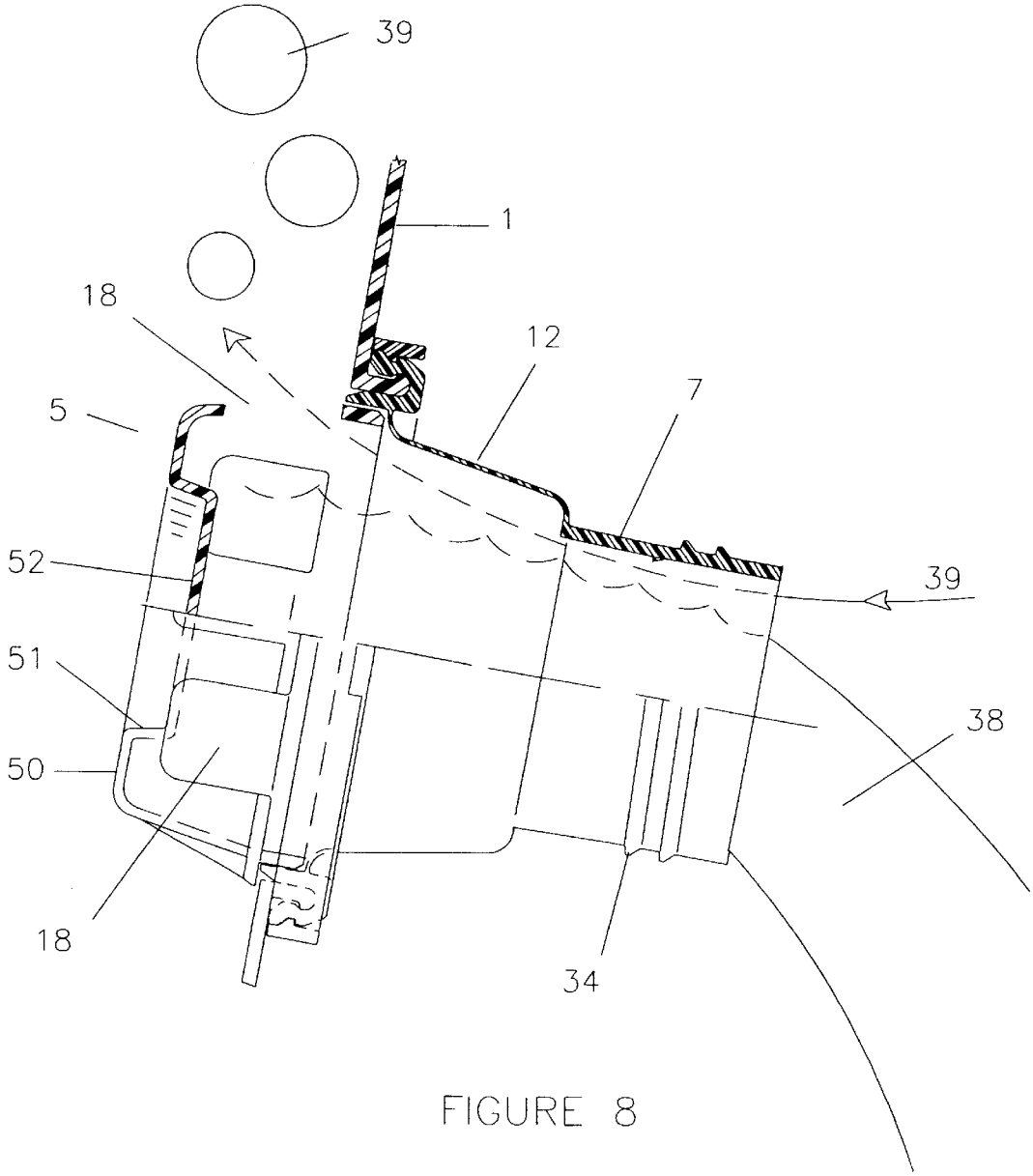
FIG. 8 is a cross-sectional view of the flow vented closure dispensing liquid.

Closure body 4 includes a skirt 8 leading to body flange 9 and funnel 12, that funnel 12 folding to a re-entrant position when closure 2 is in its storage position shown in FIG. 1 and movable to a funnel like extended position shown in FIG. 8. The funnel 12 leads to nozzle 7 (shown in FIG. 7) which may be predominately cylindrical and which incorporates threads 34 to attach the threads 33 of cap 20. Skirt 8 includes an annular recess 10 which is adapted to be secured to an opening rim 3 of a container cover 1 which is partially shown in the figures (particularly FIG. 5). The flow venting baffle 5 has a plurality of radially spaced flow vent orifices 18. The flow venting orifices control the flow of fluid 38 out of the body nozzle 7 and facilitates the entry of air 39 into the container in the manner to be described.

FIG. 1 also shows pressure cap orifice 41 and body pressure orifice 42 which allow air passage to maintain pressure equilibrium. An air permeable microporous vent 44 is mounted in cylindrical projection 40 to resist liquid loss out of the container.

Figure 2:
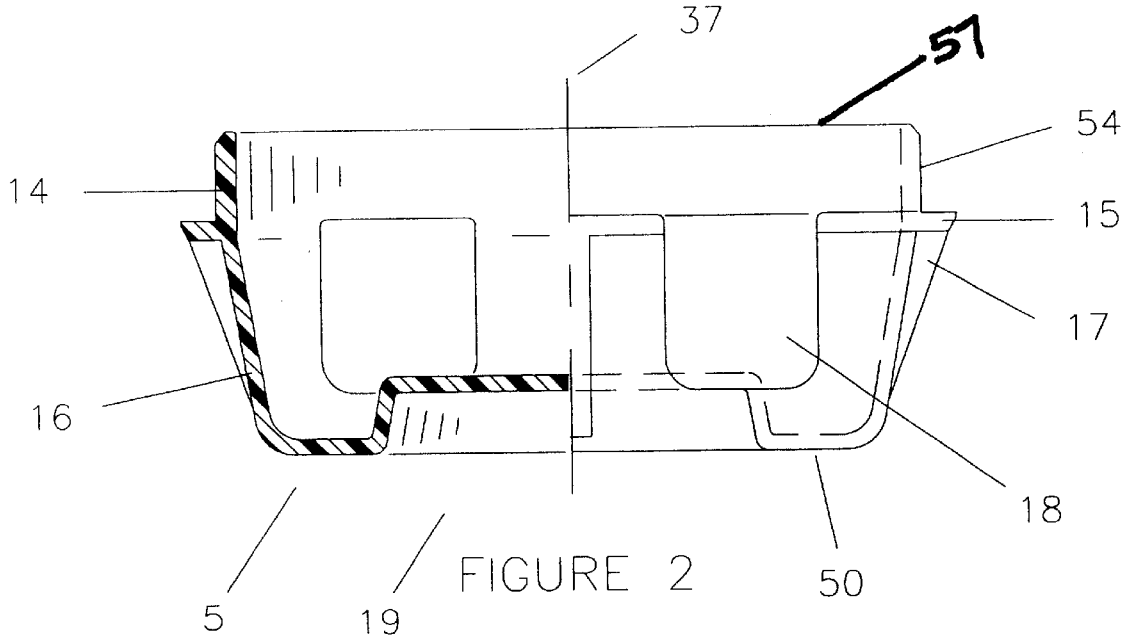
FIG. 2 is a cross-sectional side view of the flow venting baffle.

FIG. 2 is a cross-sectional view of the flow venting baffle 5. The flow venting baffle 5 may be molded of semi-rigid plastic or the like with outer wall 16 and baffle closed end 19 and top end of baffle 57. More particularly the baffle end surface 19 is defined by outer annular wall 16 merging with surfaces 50, 51 and 52. Any number of flow vent orifices 18 may be utilized to pass liquid and air in a manner to be described herein. The baffle mounting ring 14 is sized to fit on the inside of body flange 9 as shown in FIG. 1. Attachment of baffle mounting ring 14 to the body flange 9 may be accomplished by means of interference fit, thermal bonding, spin welding, adhesives or the like between the surfaces marked as 53 and 54 as shown in FIG. 4. A series of locking tabs 15 (shown in FIG. 3) project radially outwardly beyond flange 14. The tabs 15 may be sized to be larger than the inside diameter of container rim 3. A series of guide ribs 17 facilitate the alignment of the closure 2 with cover opening rim 3 during installation. Once the closure is in the installed position, the locking tabs 15 move outward to a more relaxed position. The locking tabs 15 underlie the cover opening rim 3 to resist removal. The flow vent orifices 18 carry liquid 38 out of the container and allow air 39 into the container in a manner to be described. The cover opening rim 3, closure body 4 and flow venting baffle are co-axially disposed about central axis 37.

Figure 3:
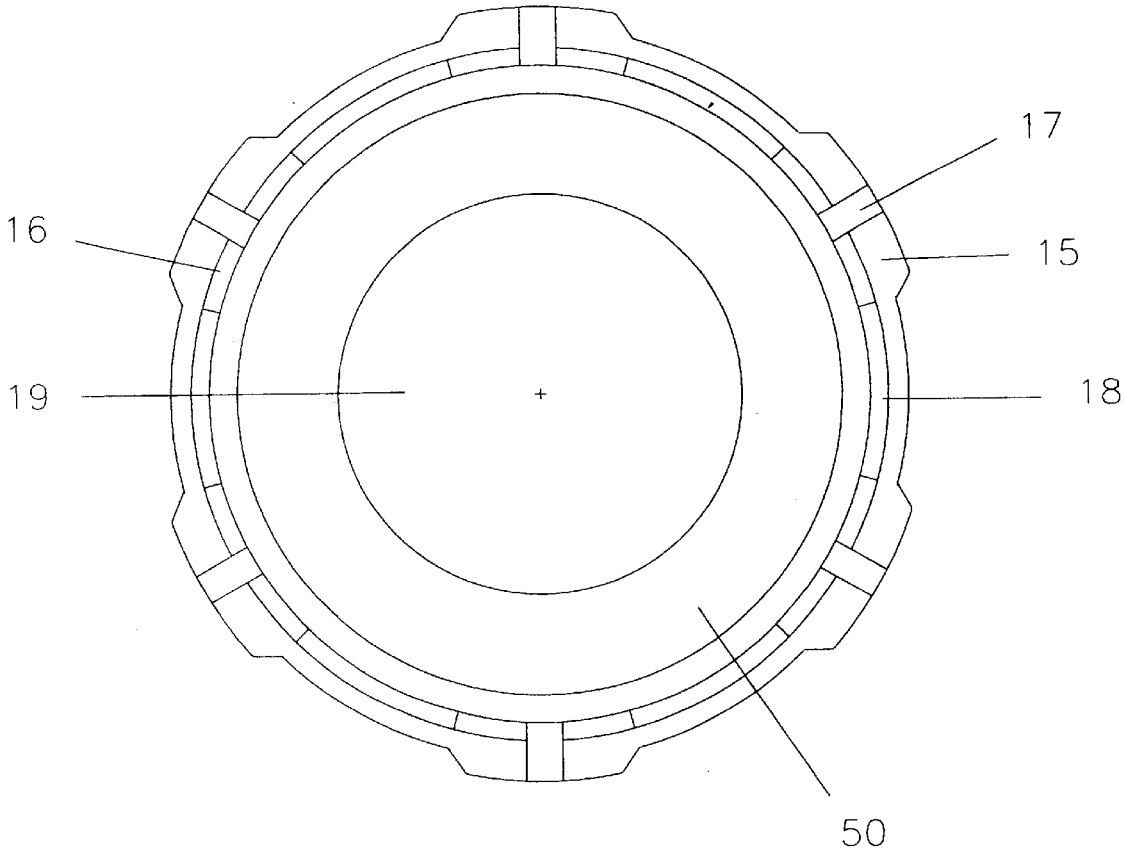
FIG. 3 is is a bottom view of the flow venting baffle.
Figure 4:
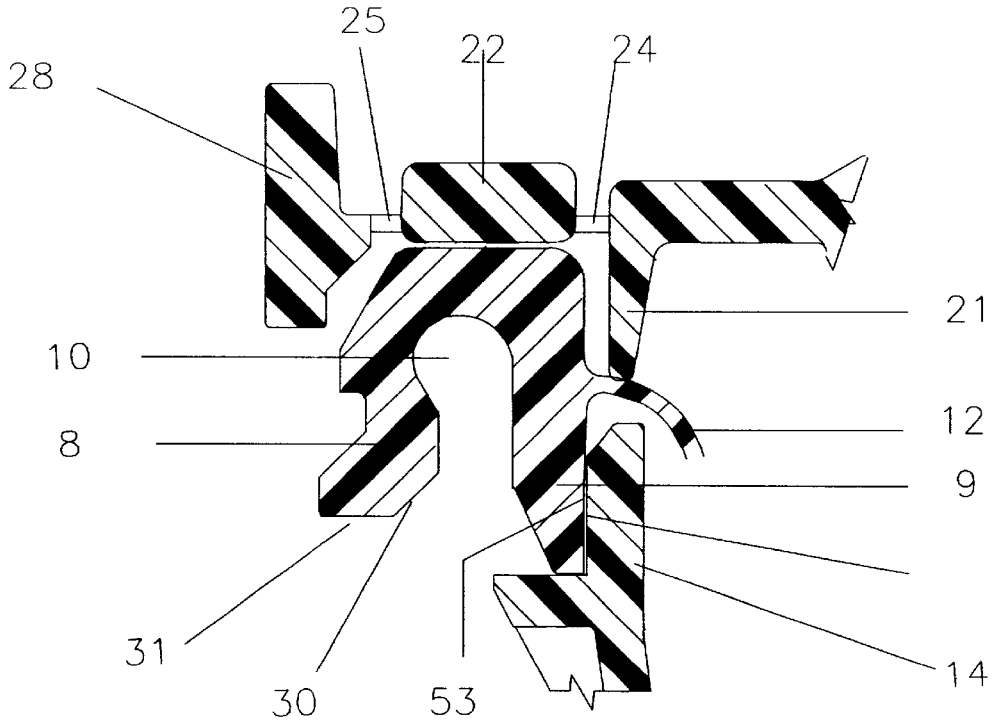
FIG. 4 is is a detailed view of the lock ring and closure skirt before installation on the container.

FIG. 3 is a bottom view of the flow venting baffle 5 and flow venting orifices 18. Six vent orifices 18 are shown but any number may be utilized, in a manner to be described.

FIG. 4 is a detailed view of the edge of cap 20 and body skirt 8 before installation on the container cover 1. The skirt 8 has a flat edge 31 and a bevel 30 to aid installation over the container rim 3 and bead 6. The cap 20 has an annular rim 21 contacting body funnel 12. The contact of rim 21 to funnel wall 12 creates a tight seal to resist liquids or other contaminants from entering the area between the funnel 12 and nozzle 7. The locking ring 28 is shown in its first unlocked position held to the cap bails 22 by frangible outer webs 25.

Figure 5:
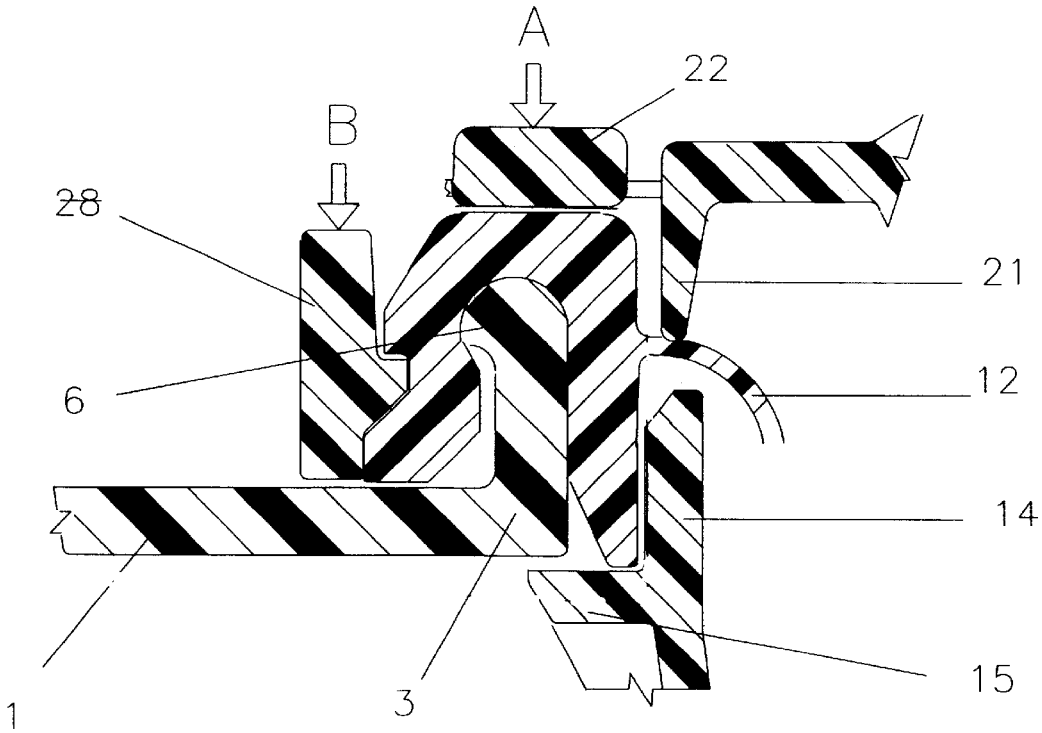
FIG. 5 is a detailed view of the closure after installation on container opening with rim and bead.

FIG. 5 illustrates the installation of closure 2 to container cover 1 whereby the body skirt 8 has been first pressed by mechanical means over rim bead 6 of the upstanding peripheral edge of cover opening rim 3 by forcing cap bail 22 in the direction of arrow A. Secondly, lock ring 28 is moved from its initial position molded to cap 20 by breaking outer frangible webs 25 in the direction of arrow B. The locking ring 28 expands, then compresses and locks to body skirt 8 against cover rim bead 6 enhancing the seal and securing the closure 2 to the container cover 1 in a manner as described in U.S. Pat. No. 5,788,100 which issued to the applicant herein. The flow baffle locking tabs 15 underlie the cover opening rim 3. This engagement provides a second means to resist removal of the closure 2 from the container cover 1.

Figure 6:
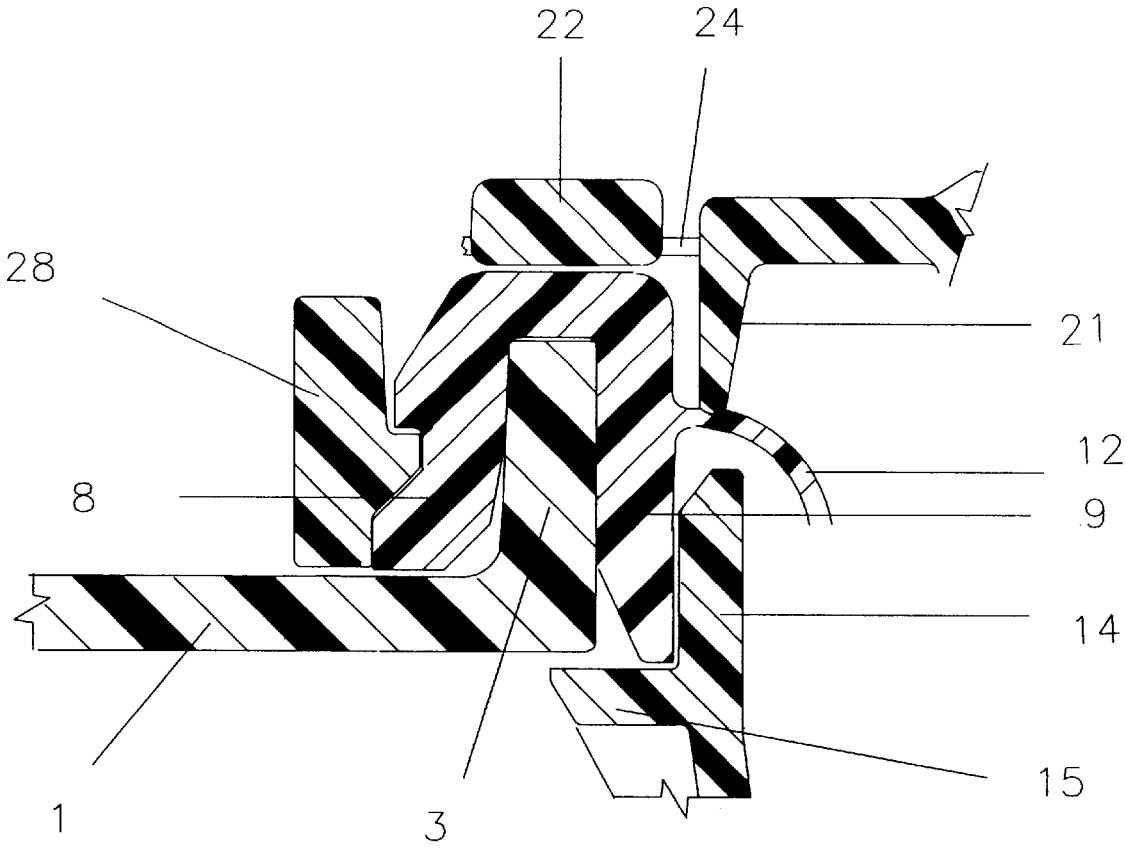
FIG. 6 is a detailed view of the closure after installation on optional container opening without bead.

FIG. 6 is a detailed view of the closure 2 after installation on an optional container opening without a bead 6. The lock ring 28 compresses the body skirt 8 against cover opening rim 3 to reinforce the seal. The flow baffle locking tabs 15 underlie the cover opening rim 3. This engagement provides a first means to resist removal of the closure 2 from the container cover 1.

The method of assembling the closure 2 to the cover opening 3 comprises threading the cap 20 onto the body nozzle when the closure body 4 is in the re-entrant position. Then attaching the baffle to the body as described above. Thereafter the closure 2 with cap 20 and baffle 5 are placed to lead into opening 3. The guide ribs 17 co-axially guide same within the opening 3. Thereafter the closure is pressed into the opening 3 with the locking tabs compressing and deforming through the opening 3 and springing back once they have passed the opening 3.

The lock ring 28 is then moved as described above so as to lock the skirt 8 to the upstanding wall of the opening as shown in FIG. 3.

The method described herein is well suited for assembling closures to container covers 1 which may be molded of plastic which has just been ejected from a machine and is still warm. Since the skirt 6 has a large angle 30 as well as horizontal surface 31 such surfaces 30 and 31 will tend to direct the upstanding cover opening rim 3 into the body skirt annular recess 10. Accordingly much larger tolerances may be utilized in the diameter of the annular upstanding cover opening rim 3. Moreover the method is well suited to co-axially guide all of the parts in a simple, quick and efficient manner. Moreover the structure of the locking projection and lock ring 28 is securely received by the locking annular recess of the body skirt 8 as shown in FIGS. 5 and 6.

The cap 20 includes two bails 22 for extending the pouring spout. The bails 22 are initially interconnected to the cap by inner frangible webs 23. The bails 22 may be lifted from the initial position shown in FIG. 1 to the extended position of FIG. 7 by lifting bails 22.

FIG. 7 is a cross-sectional side view of the pour spout closure 2 in an extended operable or pouring position. The flow venting baffle 5 does not move when the closure is extended.

FIG. 8 is a cross-sectional view of the flow vented closure 2 dispensing liquid 38 with the funnel 12 in the extended position. The flow venting baffle 5 blocks fluid from axially flowing out because of the presence of end wall surfaces 50, 51 and 52, but allows flow through the radially spaced flow vent orifices 18. The flow is restricted so that body nozzle 7 nearly flows full. This maintains an air passage 39 through the nozzle 7 to the body funnel 12 area. The flow vent orifices 18 disposed or oriented towards the top of the container allow air to enter. As can be seen from FIG. 8, the vent orifices 18 are in close proximity to the container cover 1. This improves drainability of all liquid 38.

As can be more fully seen in FIG. 8, the flow vent orifices 18 disposed on the higher side of the container relative ground level will tend to pulse rapidly alternating between exit of liquid 38 outwardly and entry of air 39. The lower orifices 18 (namely those vents which have been disposed closer to the ground) tend to accommodate liquid 38 flow. Moreover since the baffle 5 is fixed next to the container cover 1, and since the orifices 18 are directed radially outwardly, the air exchange through the orifices 18 is optimally located compared to prior art disclosures. Furthermore it should be noted tat when pulsating of air and liquid through the higher orifices 18, this uneven flow is smoothed by the major flow through die lower orifices 18. By the time the liquid exits nozzle 7 there is a smooth flow of liquid outwardly from container.

It bas been observed that by increasing the size of the flow vent orifices 18 to compensate for higher viscosity liquids, faster pour rates may be achieved. Furthermore the number of orifices 18 may also be matched to the viscosity of the liquid. The baffle end wall surfaces 50, 51 and 52 shown in FIG. 8 act to reduce the effect of liquid sloshing back and forth within the container.

Figure 9:
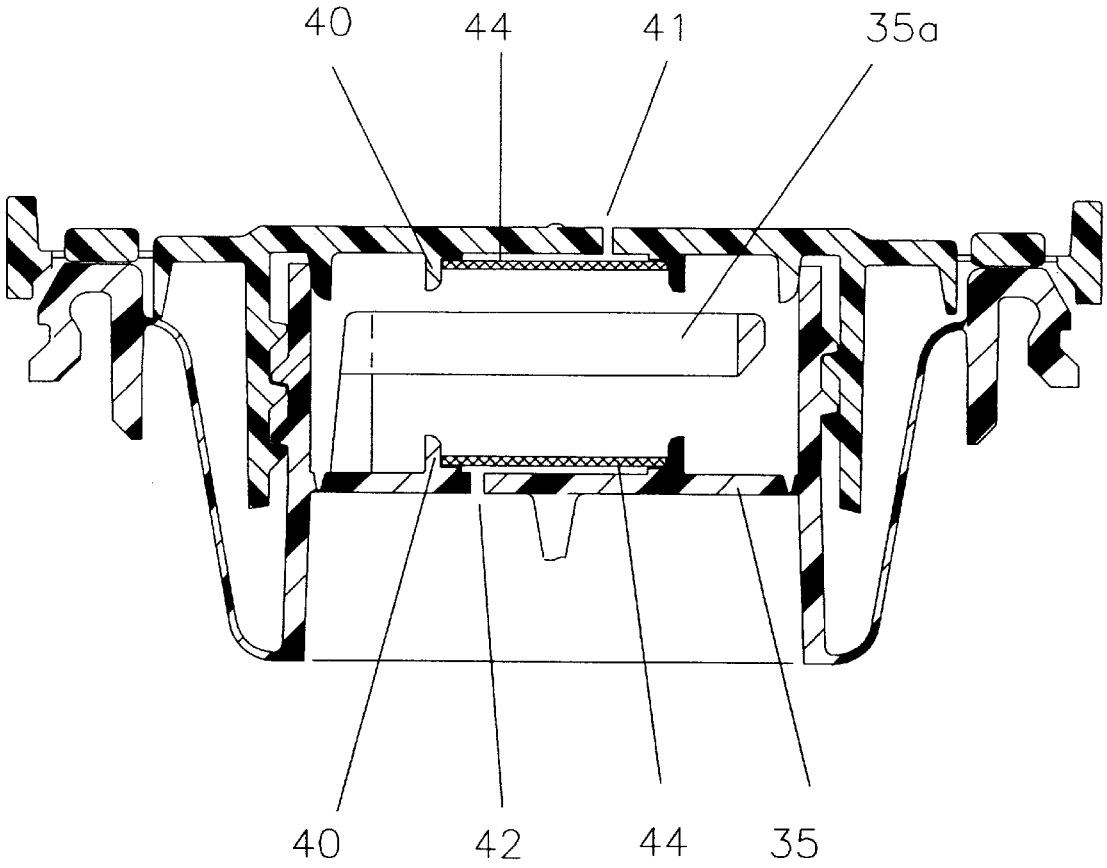
FIG. 9 is a cross-sectional view of a pressure vented pour spout closure.
Figure 10:
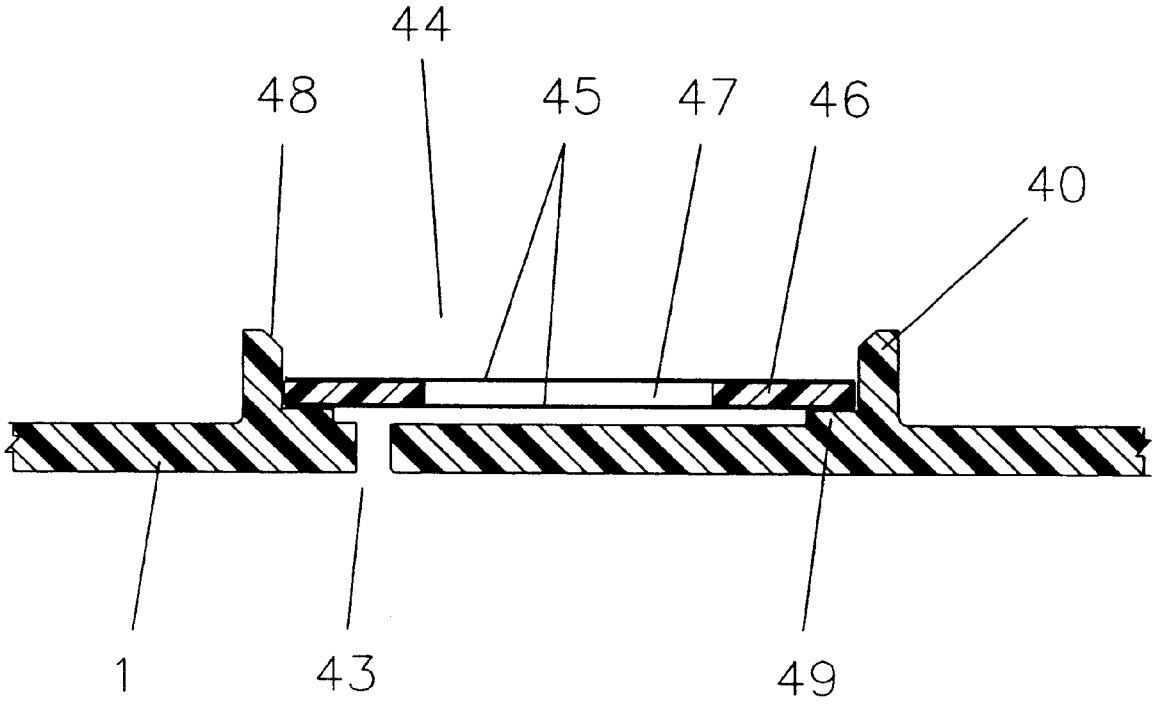
FIG. 10 is a derailed side view of the cylindrical projection and membrane disc.

FIG. 9 is a cross-sectional side view of another embodiment of the invention with a pressure vented pour spout closure. The body orifice 42 and cap orifice 41 are created for an air passage through the closure 2. A cylindrical projection 40 (which can be but does not need to be an annular projection) is molded to the cap 20 or body removable diaphragm 35. The diaphragm 35 is removed before liquid dispensing by pulling 35*a* in a manner well known to those skilled in he art. A gas permeable but liquid retentive microporous vent 44 is installed inside the cylindrical projection(s) 40.

Figure 11:
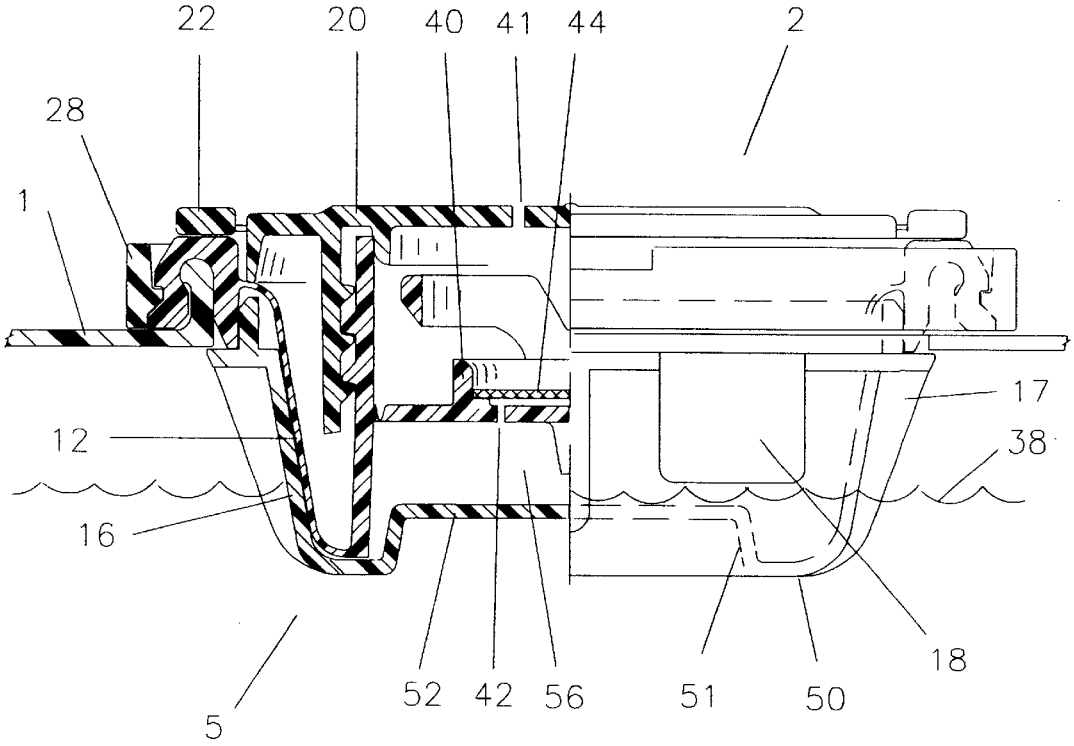
FIG. 11 is a cross-sectional side view of a flow vented and pressure vented pour spout closure mounted to a container cover and partially submerged in liquid.

FIG. 11 is a cross-sectional side view of a flow vented and pressure vented pour spout closure 2 mounted to a container cover 1 and partially submerged in liquid 38. FIG. 11 is an optional arrangement of FIG. 1 wherein the upstanding baffle outer wall 16 is sized to be in contact with body funnel 12. The contact between walls 16 and funnel 12 acts to close the flow vent orifices 18 when the spout is in the re-entrant position as shown in FIG. 11. The closed orifices 18 resist liquid from entering the body nozzle sump 56 and coming into contact with the microporous vent 44.

A separate path is provided to carry any gases from the area under the container cover 1 to the body nozzle sump 56. One or more body pressure vent channel(s) 55 as shown in cross-section in FIG. 12 begin near the baffle mounting ring 14 and lead to the end wall sump 52. The pressure vent channel(s) 55 are formed on the inside surface of baffle outer wall 16.

Figure 12:
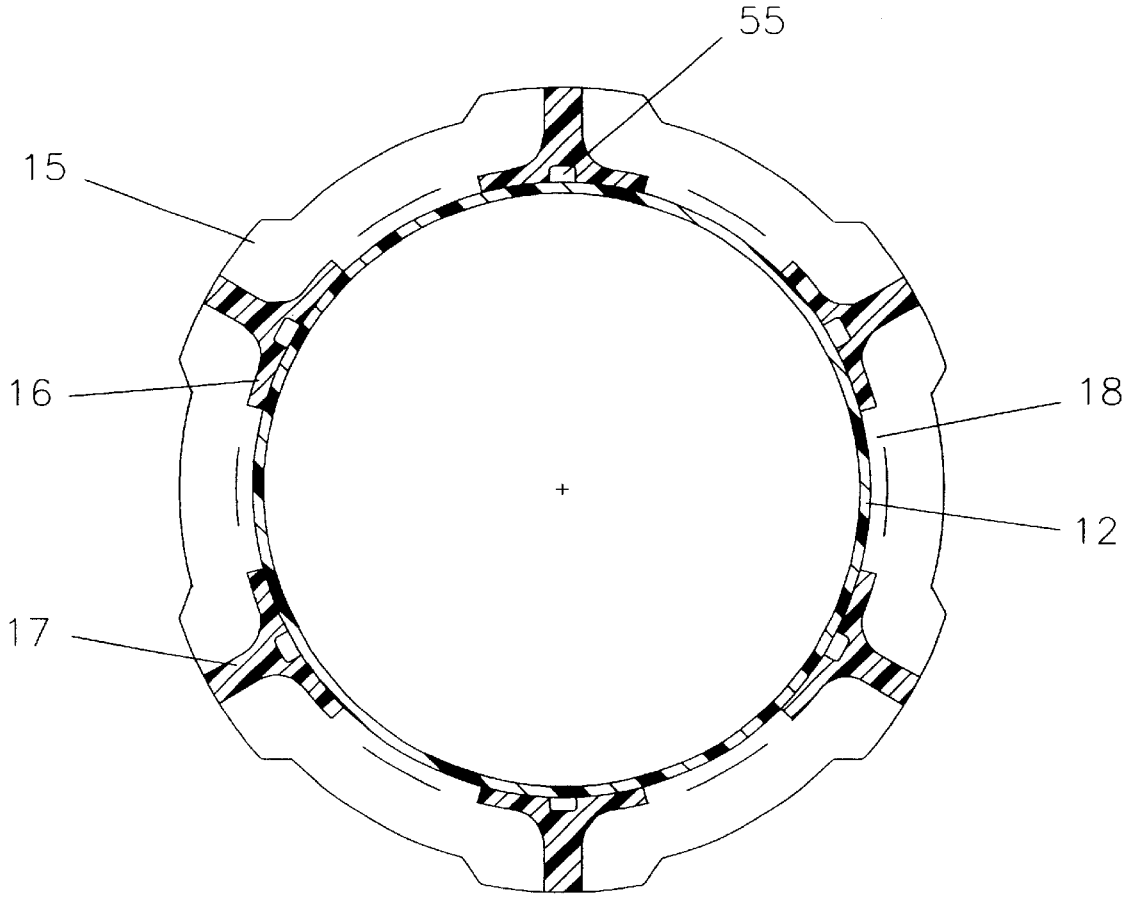
FIG. 12 is a cross-sectional view of the flow venting baffle and body funnel.

FIG. 12 is a cross-sectional bottom view of the flow venting baffle 5 and body funnel 12. The pressure channel(s) 55 are shown as rectangular and underlying each guide rib 17, but channels 55 may be of any size or shape and quantity sufficient to relieve pressure inside the container.

Since applicant utilizes a baffle 5 with no central pathway to the nozzle, the baffle 5 will assist in preventing liquid from contacting the body orifice 42 or cap orifice 41, thus preventing liquid from splashing and wetting thereon and minimizing any problems associated with blocking of the orifices.

The drawings also show a flow vented closure in which the upstanding outer wall and ribs of the baffle are tapered to a smaller diameter at the leading edge to facilitate insertion into cover openings for manual and automatic assembly operations.

The closure body may be made of a single piece of molded plastic of flexible low density polyethylene or the like. The cap element and locking ring is initially of a single piece of molded plastic of high density polyethylene or the like. The baffle may be molded of semi-rigid polyethylene or the like.

The pressure vent may be a semi-rigid microporous material, or a flexible microporous teflon membrane or the like attached to a plastic mounting disc.

Various embodiments of the invention have now been described in detail. Since changes in and/or additions to the above-described best mode may be made without departing from the nature, spirit or scope of the invention, the invention is not to be limited to said details.

Although the preferred embodiment as well as the operation and use have been specifically described in relation to the drawings, it should be understood that variations in the preferred embodiment could be achieved by a person skilled in the trade without departing from the spirit of the invention as claimed herein.

I claim:

1. A flow venting baffle for a closure connect to a container, wherein said baffle is cup shaped and adapted to underlie said closure and presents at one end a bottom surface for blocking liquid flow to said closure, said bottom surface merging with an upstanding outer sidewall, and a plurality of flow vent orifices selected for regulating liquid exit and entry of air adjacent to said container at a top end of said baffle for regulating the flow of liquid and air, said baffle including a plurality of guide ribs to stiffen said baffle wherein said sidewall tapers outwardly from said end surface to said flow vent orifices and said closure and baffle are co-axially disposed about a central axis.

2. A baffle as claimed in claim 1 wherein said sidewall and ribs terminate at said top end, and said top end includes tab means adapted to underlie said cover opening.

3. A baffle as claimed in claim 2 wherein said tab means have a diameter greater than the diameter of said container opening to resist removal from said container.

4. A baffle as claimed in claim 3 wherein said closure includes pressure venting means, said end surface of said baffle blocking liquid from splashing said pressure venting means.

5. A baffle as claimed in claim 4 wherein said pressure venting means comprises a gas permeable microporous membrane attached to a mounting disc, said pressure vent in combination with pressure vent orifices provide a path through said closure to keep the pressure inside the container equal to the atmospheric pressure.

6. A baffle as claimed in claim 5 wherein said pressure venting means comprises a disc shaped microporous material mounted and held within a cylindrical projection molded to a body removable diaphragm of said closure.

7. A baffle as claimed in claim 3 wherein said top end is open and said sidewall and ribs terminate at said open top end, and said top end includes tab means to underlie said cover opening.

8. A baffle as claimed in claim 7 wherein said open other end has a mounting means for attachment in co-axial alignment to a closure body.

9. A baffle as claimed in claim 8 wherein said baffle tapered sidewalls closely contact a body funnel of said closure when said closure is in the re-entrant position.

10. A baffle as claimed in claim 9 wherein contact between the sidewalls and said funnel close said flow venting orifices.

11. A baffle as claimed in claim 9 wherein said closure includes pressure venting means, said end surface and said closed flow venting orifices blocking liquid from splashing or flooding said pressure venting means.

12. A baffle as claimed in claim 1 wherein at least one of said guide ribs include a channel for relieving pressure.

* * * * *